US006336234B1

(12) United States Patent
Kuo

(10) Patent No.: US 6,336,234 B1
(45) Date of Patent: Jan. 8, 2002

(54) BOTTOM FRAME STRUCTURE FOR PLAYPEN

(76) Inventor: Shu-Yu Kuo, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/638,138

(22) Filed: Aug. 8, 2000

(51) Int. Cl.[7] ..... A47C 9/00
(52) U.S. Cl. ..... 5/99.1; 5/93.1
(58) Field of Search ..... 5/93.1, 99.1, 98.1, 5/98.2

(56) References Cited

U.S. PATENT DOCUMENTS 5,890,236 A * 4/1999 Wu ..... 5/99.1
5,911,653 A * 6/1999 Cheng ..... 5/99.1
5,970,540 A * 10/1999 Cheng ..... 5/99.1

* cited by examiner

*Primary Examiner*—Lynne H. Browne
*Assistant Examiner*—Fredrick Conley

(57) ABSTRACT

A bottom frame structure for a playpen includes four upright rods, a bottom frame, a positioning base, and a top frame. The four upright rods are respectively located at four corners of the playpen for supporting and linking between the bottom frame and the top frame. The bottom frame is mounted on the lower end of the four upright rods and includes four first rods, two Y-shaped first connecting bases, four universal joints, four second rods, two T-shaped second connecting bases, and four third rods. The positioning base is used to link the four third rods and includes a cruciform body, four fitting rod members, four U-shaped urging drive blocks, four elastic members, and a release block.

2 Claims, 9 Drawing Sheets

BOTTOM FRAME STRUCTURE FOR PLAYPEN

BACKGROUND OF THE INVENTION

1. Field of the Invention

The present invention relates to a bottom frame structure for a playpen.

2. Description of the Related Art

A conventional bottom frame structure for a playpen in accordance with the prior art shown in FIG. 1 comprises a joint base 20 pivotally mounted between two rods 10 whereby the two rods 10 can be pivoted relative to each other so as to fold the bottom frame structure of the playpen. However, the bottom frame structure is not provided with any positioning device so that it is easily folded by an external force, thereby easily causing danger to the baby placed in the playpen.

SUMMARY OF THE INVENTION

In accordance with one aspect of the present invention, there is provided a bottom frame structure for a playpen comprising: four upright rods, a bottom frame, a positioning base, and a top frame, wherein, the four upright rods are respectively located at four corners of the playpen for supporting and linking between the bottom frame and the top frame, two of the upright rods having a lower end secured with an inverted L-shaped support base, and the other two of the upright rods having a lower end secured with an inverted L-shaped wheel base having a roller;

the bottom frame is mounted on the lower end of the four upright rods and includes four first rods, two Y-shaped first connecting bases, four universal joints, four second rods, two T-shaped second connecting bases, and four third rods, the four first rods each having a first end respectively pivoted to the horizontal section of the two support bases and the two wheel bases, each of the two Y-shaped first connecting bases having three radially arranged pivot grooves and having a bottom secured with a resting post for supporting the first connecting base, two of the three pivot grooves of each of the two Y-shaped first connecting bases pivotally receiving a second end of each of the four first rods, each of the four universal joints including a sleeve secured on a mediate portion of each of the four first rods, and a U-shaped pivot section which is rotatable toward any direction, each of the four second rods having a first end pivoted to the pivot section of each of the four universal joints so that the four first rods and the four second rods form a rectangular frame, each of the two T-shaped second connecting bases having three pivot slots and having a bottom secured with a resting rod for supporting the second connecting base, two of the pivot slots of each of the two T-shaped second connecting bases being in line with each other and each pivotally receiving a second end of each of the four second rods, the four third rods being arranged between the first rods and the second rods in a cross intersecting manner, two of the four third rods having a first end pivoted to the pivot groove of each of the two first connecting bases and a second end connected to the positioning base, and the other two of the four third rods having a first end pivoted to the pivot slot of each of the two second connecting bases and a second end connected to the positioning base;

the positioning base is used to link the four third rods and includes a cruciform body, four fitting rod members, four U-shaped urging drive blocks, four elastic members, and a release block, the body including four chambers each having an opening directed downward for receiving the second end of each of the four third rods, each of the four chambers having two side walls each defining a substantially L-shaped slide slot having an oblique upper end and a horizontal lower end and a circular hole located beside the horizontal lower end, the body having a top formed with four inclined surfaces each defining a rectangular slot connecting to each of the four chambers, and having a bottom secured with an abutting column, each of the four fitting rod members having a first end provided with an insertion section secured and locked in the second end of each of the third rods by a threaded rod engaged with a nut, and a second end provided with a snap abutting section defining a transverse through hole and provided with an L-shaped snap abutting recess, a rivet pin in turn extending through the circular hole of each of the four chambers of the body and through the through hole of the snap abutting section of each of the four fitting rod members, so that each of the four fitting rod members is pivoted to each of the four chambers of the body, each of the four urging drive blocks having two side walls each defining a circular hole and having a top portion provided with a rectangular bar having an upper section protruding outward from the rectangular slot of the body and defining a through hole, a lock pin in turn extending through the slide slot of the body and through the circular hole of each of the four urging drive blocks, so that the lock pin is detachably rested on the snap abutting recess of each of the four fitting rod members, each of the four elastic members is mounted around the rectangular bar of each of the four urging drive blocks and having a lower end pressing the top portion of each of the four urging drive blocks and an upper end pressing an upper wall of each of the four chambers of the body, and the release block movably mounted on the body and defining two spaced slot holes for allowing passage of a loop-shaped lift strap, the release block having four sides each provided with two spaced abutting plates rested on each of the four inclined surfaces of the body, the rectangular bar of each of the four urging drive blocks being received between the two abutting plates, each of the abutting plates defining a circular hole aligning with the through hole of the rectangular bar of each of the four urging drive blocks, a pivot rod in turn extending through the circular hole of each of the abutting plates and through the through hole of the rectangular bar, thereby pivoting the rectangular bar to the abutting plates of the release block.

The primary objective of the present invention is to provide a bottom frame structure for a playpen, wherein, the positioning function of the bottom frame can be used to control the folding and expanding actions of the skeleton of the playpen, thereby preventing the skeleton of the playpen from being easily folded due to the hit of an external force so as to protect the safety of the playpen.

Another objective of the present invention is to provide a bottom frame structure for a playpen, wherein, the support points and the connection points of the skeleton of the playpen have a rigid strength, thereby enhancing the loading and supporting strength of the playpen.

Further benefits and advantages of the present invention will become apparent after a careful reading of the detailed description with appropriate reference to the accompanying drawings.

DETAILED DESCRIPTION OF THE INVENTION

Figure 1:
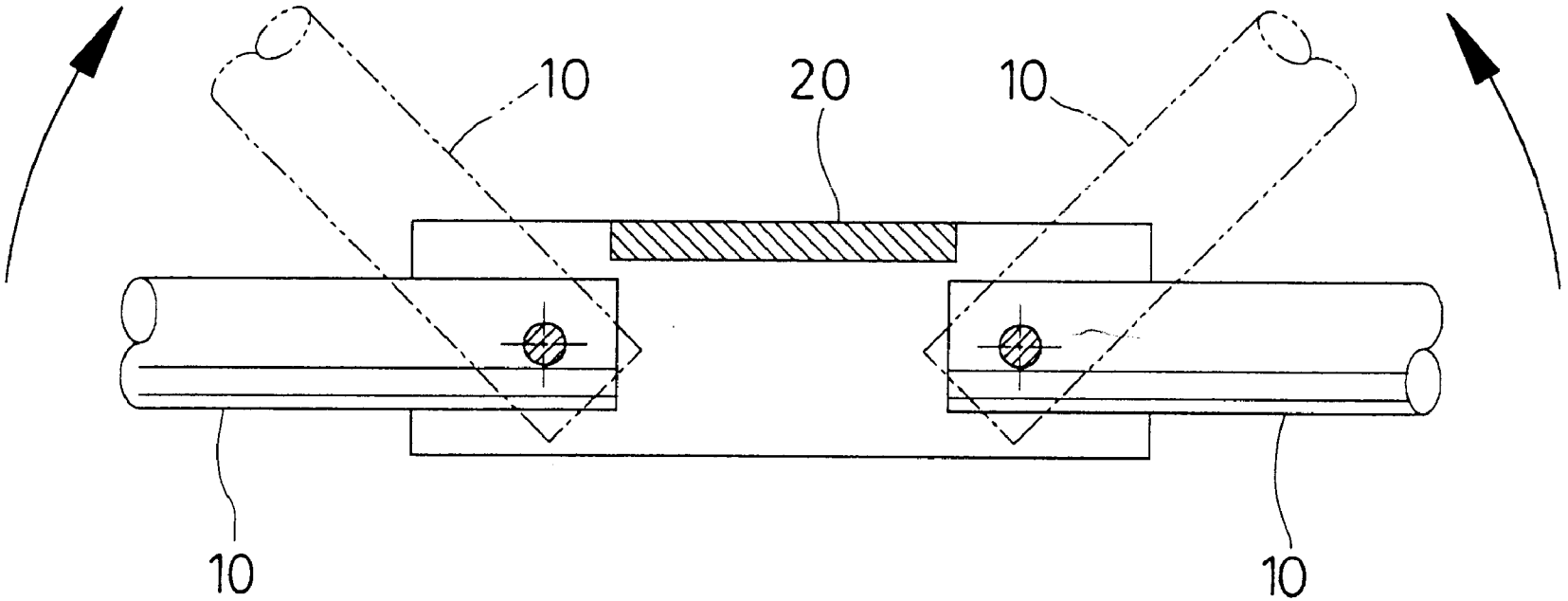
FIG. 1 is an operational plan view of a conventional bottom frame structure for a playpen in accordance with the prior art.
Figure 2:
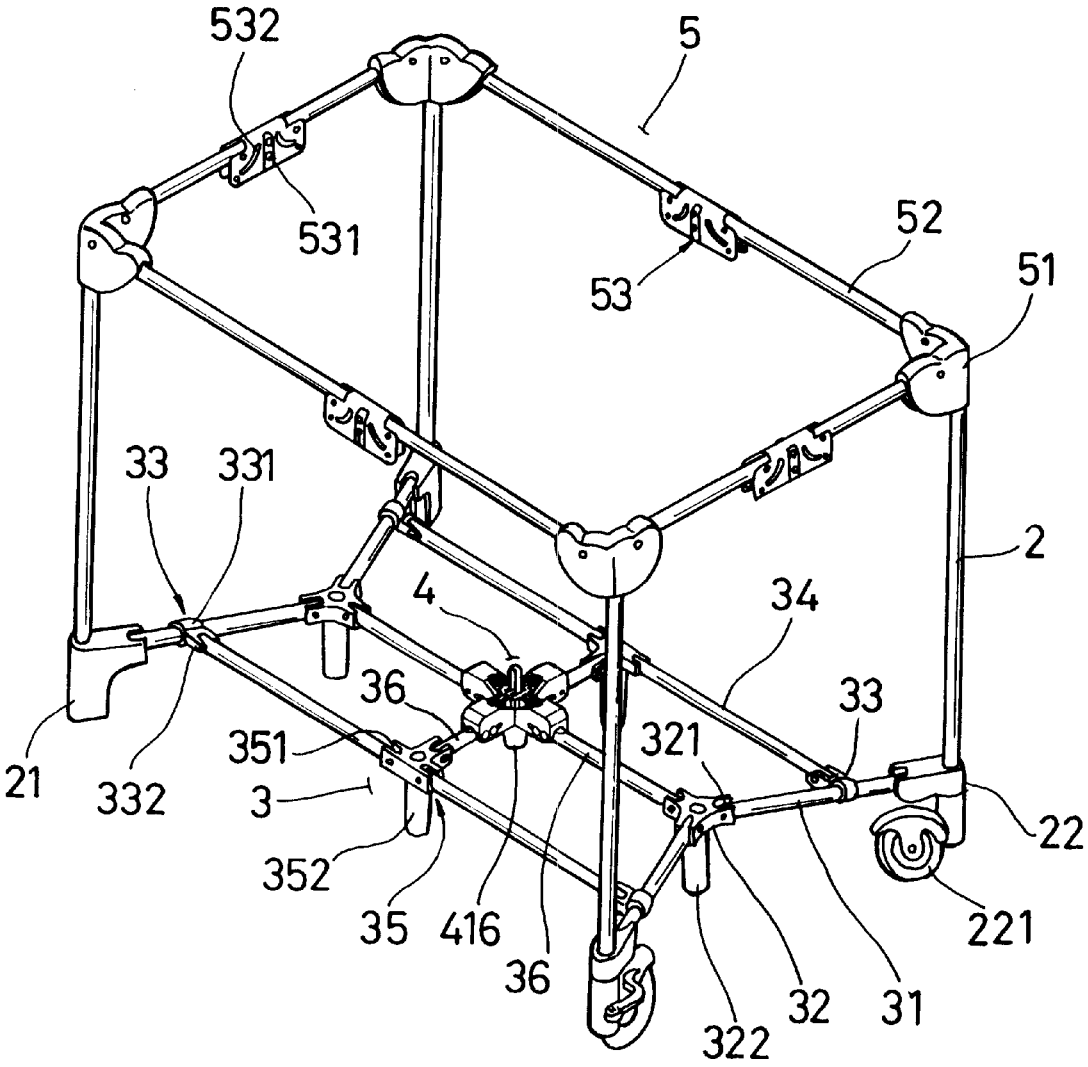
FIG. 2 is a perspective view of a bottom frame structure for a playpen in accordance with the present invention.
Figure 3:
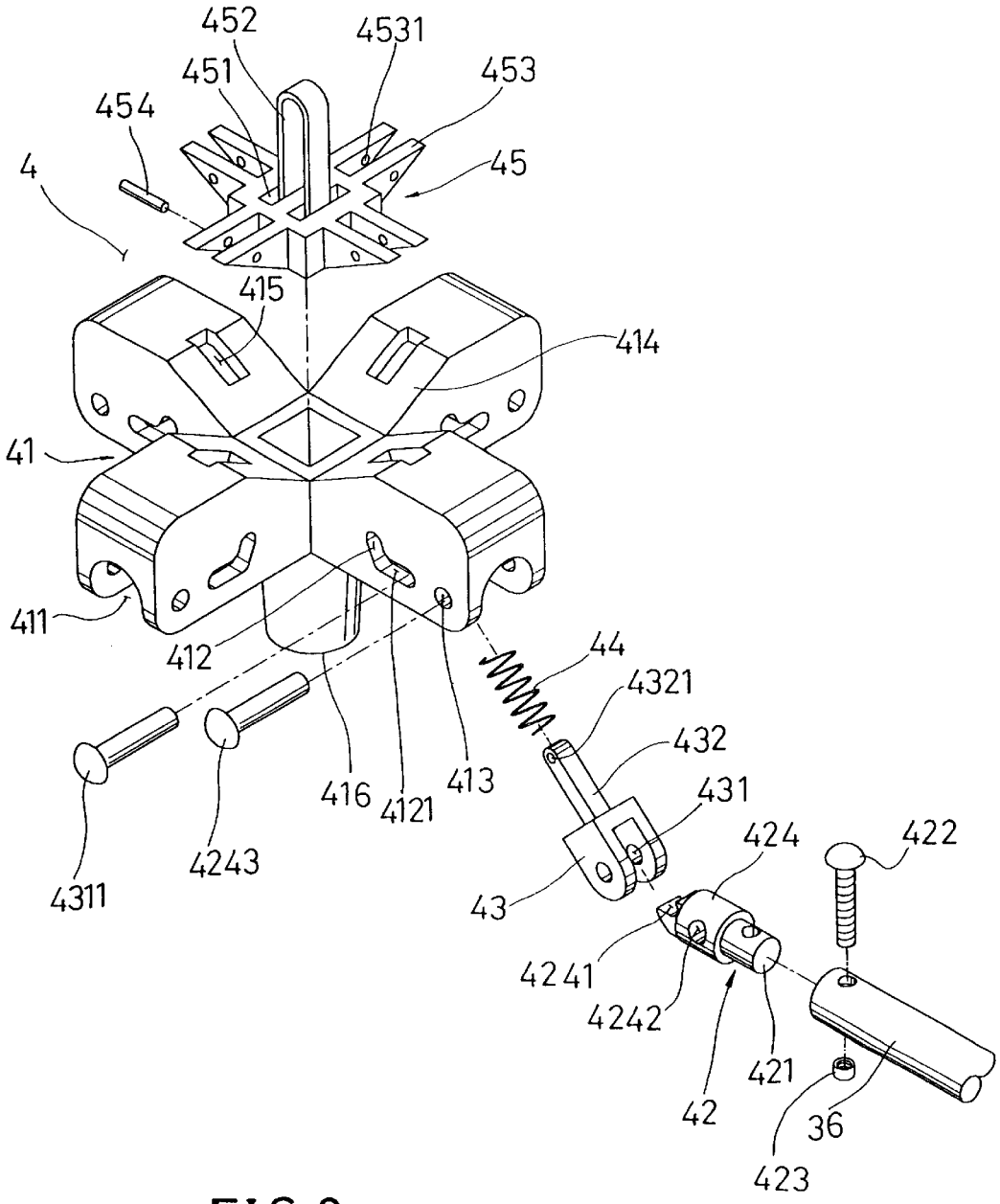
FIG. 3 is an exploded view of a positioning base of the bottom frame structure for a playpen in accordance with the present invention.
Figure 4:
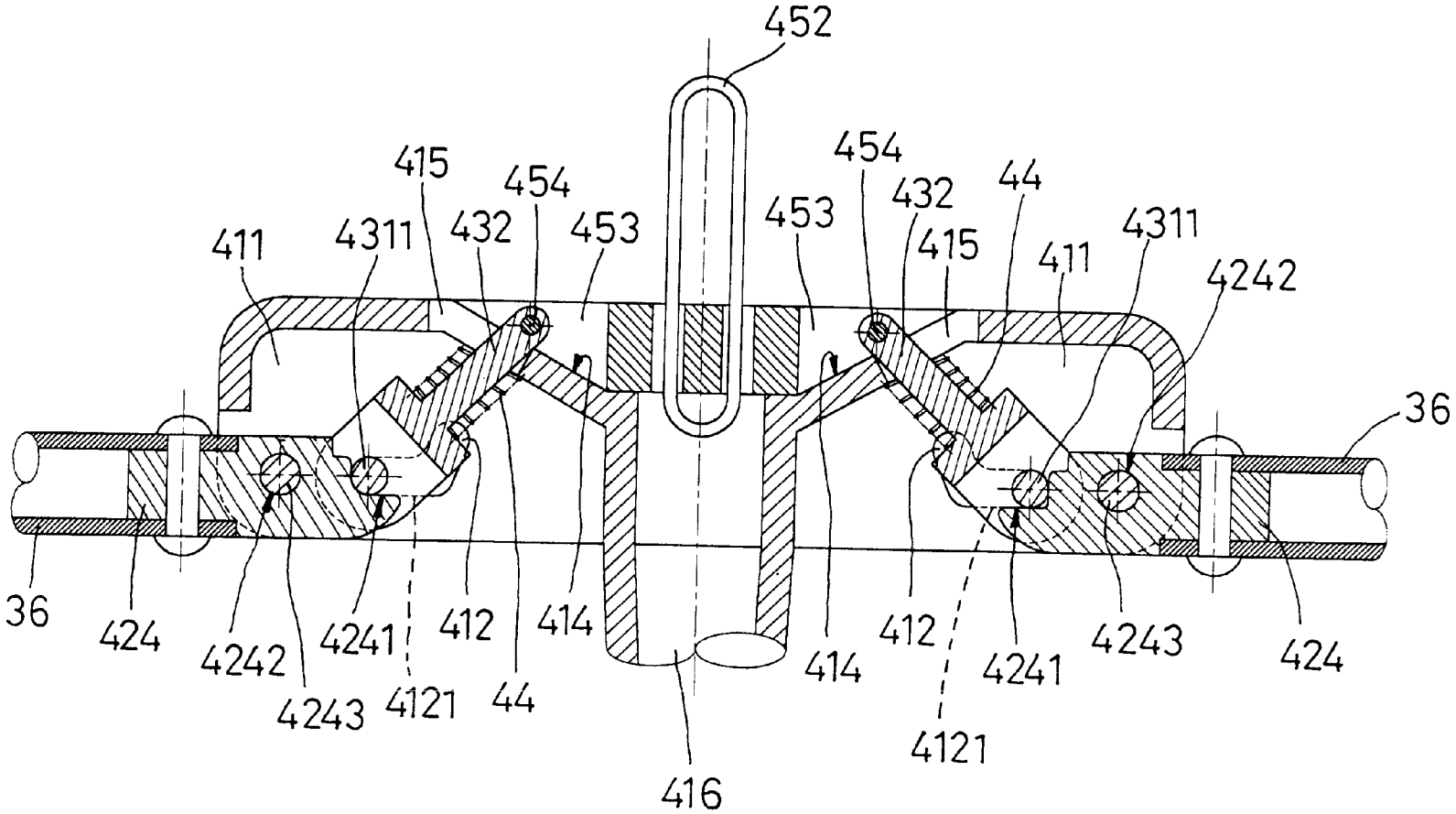
FIG. 4 is a front plan cross-sectional view of the positioning base as shown in FIG. 3.
Figure 5:
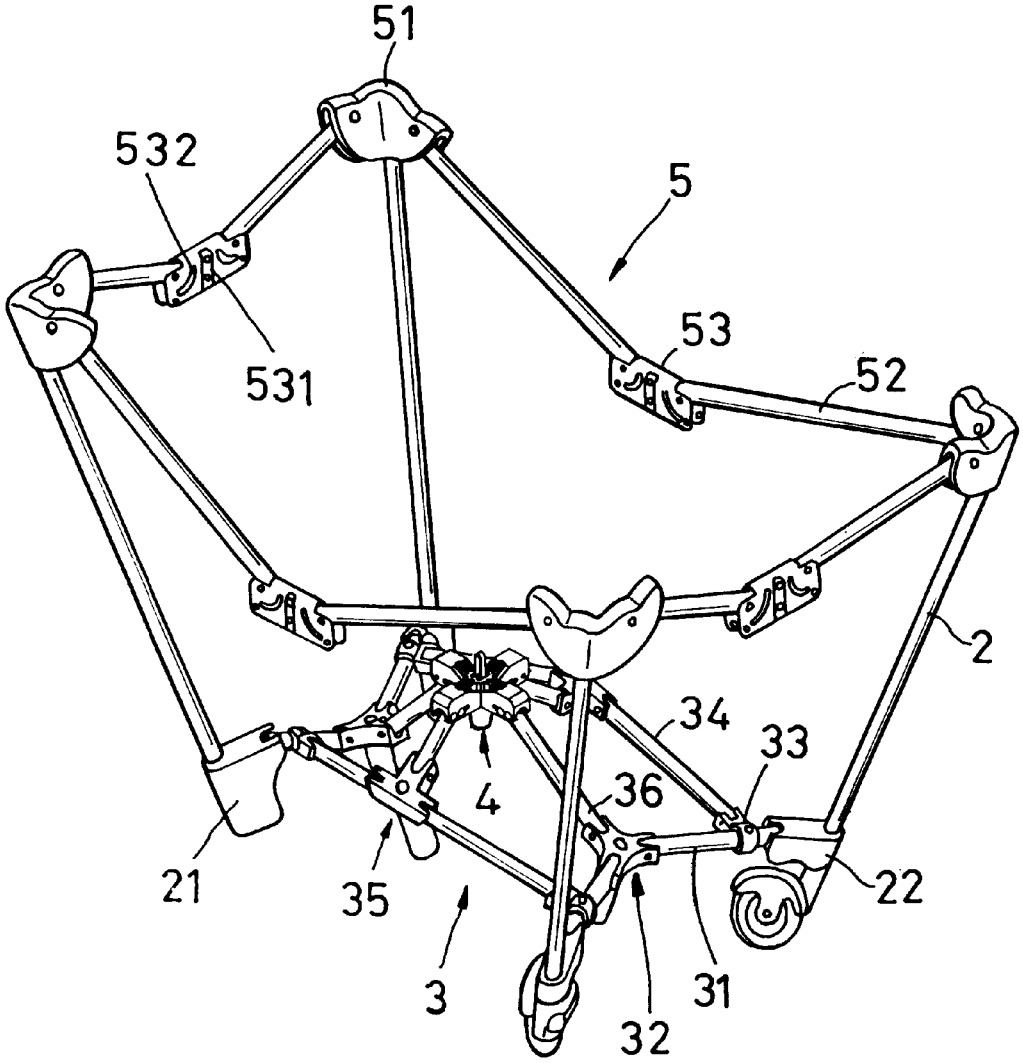
FIG. 5 is an operational view of the playpen as shown in FIG. 2.

Referring to the drawings and initially to FIGS. 2–4, a bottom frame structure for a playpen in accordance with the present invention comprises four upright rods 2, a bottom frame 3, a positioning base 4, and a top frame 5.

The four upright rods 2 are respectively located at four corners of the playpen for supporting and linking between the bottom frame 3 and the top frame 5, two of the upright rods 2 having a lower end secured with an inverted L-shaped support base 21, and the other two of the upright rods 2 having a lower end secured with an inverted L-shaped wheel base 22 having a roller 221.

The bottom frame 3 is mounted on the lower end of the four upright rods 2 and mainly includes four first rods 31, two Y-shaped first connecting bases 32, four universal joints 33, four second rods 34, two T-shaped second connecting bases 35, and four third rods 36.

The four first rods 31 each have a first end respectively pivoted to the horizontal section of the two support bases 21 and the two wheel bases 22. Each of the two Y-shaped first connecting bases 32 has three radially arranged pivot grooves 321 and having a bottom secured with a resting post 322 for supporting the first connecting base 32, two of the three pivot grooves 321 of each of the two Y-shaped first connecting bases 32 pivotally receiving a second end of each of the four first rods 31. Each of the four universal joints 33 includes a sleeve 331 secured on a mediate portion of each of the four first rods 31, and a U-shaped pivot section 332 which is rotatable toward any direction. Each of the four second rods 34 has a first end pivoted to the pivot section 332 of each of the four universal joints 33 so that the four first rods 31 and the four second rods 34 form a rectangular frame. Each of the two T-shaped second connecting bases 35 has three pivot slots 351 and having a bottom secured with a resting rod 352 for supporting the second connecting base 35, two of the pivot slots 351 of each of the two T-shaped second connecting bases 35 being in line with each other and each pivotally receiving a second end of each of the four second rods 34. The four third rods 36 are arranged between the first rods 31 and the second rods 34 in a cross intersecting manner, two of the four third rods 36 having a first end pivoted to the pivot groove 321 of each of the two first connecting bases 32 and a second end connected to the positioning base 4, and the other two of the four third rods 36 having a first end pivoted to the pivot slot 351 of each of the two second connecting bases 35 and a second end connected to the positioning base 4.

The positioning base 4 is used to link the four third rods 36 and includes a cruciform body 41, four fitting rod members 42, four U-shaped urging drive blocks 43, four elastic members 44, and a release block 45.

The body 41 includes four chambers 411 each having an opening directed downward for receiving the second end of each of the four third rods 36, each of the four chambers 411 having two side walls each defining a substantially L-shaped slide slot 412 having an oblique upper end and a horizontal lower end 4121 and a circular hole 413 located beside the horizontal lower end 4121, the body 41 having a top formed with four inclined surfaces 414 each defining a rectangular slot 415 connecting to each of the four chambers 411, and having a bottom secured with an abutting column 416. Each of the four fitting rod members 42 has a first end provided with an insertion section 421 secured and locked in the second end of each of the third rods 36 by a threaded rod 422 engaged with a nut 423, and a second end provided with a snap abutting section 424 defining a transverse through hole 4242 and provided with an L-shaped snap abutting recess 4241, a rivet pin 4243 in turn extending through the circular hole 413 of each of the four chambers 411 of the body 41 and through the through hole 4242 of the snap abutting section 424 of each of the four fitting rod members 42, so that each of the four fitting rod members 42 is pivoted to each of the four chambers 411 of the body 41. Each of the four urging drive blocks 43 has two side walls each defining a circular hole 431 and having a top portion provided with a rectangular bar 432 having an upper section protruding outward from the rectangular slot 415 of the body 41 and defining a through hole 4321, a lock pin 4311 in turn extending through the slide slot 412 of the body 41 and through the circular hole 431 of each of the four urging drive blocks 43, so that the lock pin 4311 is detachably rested on the snap abutting recess 4241 of each of the four fitting rod members 42. Each of the four elastic members 44 is mounted around the rectangular bar 432 of each of the four urging drive blocks 43, and having a lower end pressing the top portion of each of the four urging drive blocks 43 and an upper end pressing an upper wall of each of the four chambers 411 of the body 41. The release block 45 is movably mounted on the body 41 and defining two spaced slot holes 451 for allowing passage of a loop-shaped lift strap 452, the release block 45 having four sides each provided with two spaced abutting plates 453 rested on each of the four inclined surfaces 414 of the body 41, the rectangular bar 432 of each of the four urging drive blocks 43 being received between the two abutting plates 453, each of the abutting plates 453 defining a circular hole 4531 aligning with the through hole 4321 of the rectangular bar 432 of each of the four urging drive blocks 43, a pivot rod 454 in turn extending through the circular hole 4531 of each of the abutting plates 453 and through the through hole 4321 of the rectangular bar 432, thereby pivoting the rectangular bar 432 to the abutting plates 453 of the release block 45.

The top frame 5 includes four pivot bases 51 each secured on the top of each of the four upright rods 2 and each having two sides each pivotally provided with a support rod 52, thereby forming a rectangular frame, and four joint bases 53 each pivotally mounted between two adjacent support rods 52. Each of the joint bases 53 is provided with an elastic piece section 531 and two locking slots 532 for fixing or bending the support rods 52.

In operation, referring to FIGS. 2–6, the elastic piece section 531 of the joint base 53 is pressed by the user, thereby detaching the support rods 52 from the locking slots 532 so that the support rods 52 can be pivoted toward each other.

Figure 6:
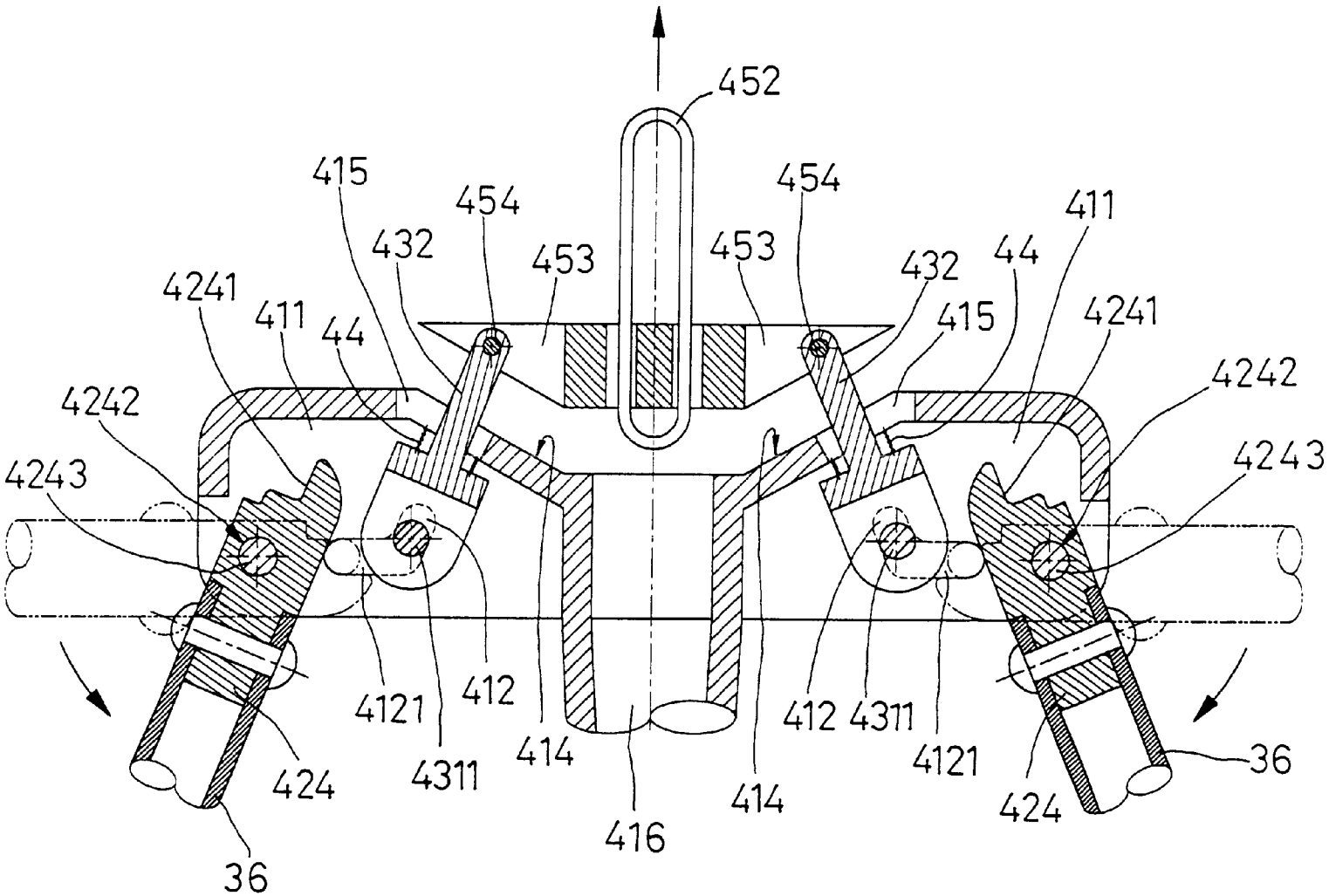
FIG. 6 is an operational view of the positioning base as shown in FIG. 4.

The lift strap 452 of the positioning base 4 is then pulled upward to move the release block 45 upward, to move the rectangular bar 432 upward by the abutting plates 453, to move the lock pin 4311 of the urging drive block 43 from the horizontal lower end 4121 to the oblique upper end of the slide slot 412 as shown in FIG. 6, thereby detaching the lock pin 4311 from the snap abutting recess 4241 of the fitting rod member 42, so that the third rod 36 can be pivoted about the rivet pin 4243 to move toward the center of the bottom frame 3 while the first rods 31 and the second rods 34 are also moved toward the center of the playpen by the drawing action of the third rods 36, thereby easily folding the skeleton of the playpen.

Figure 7:
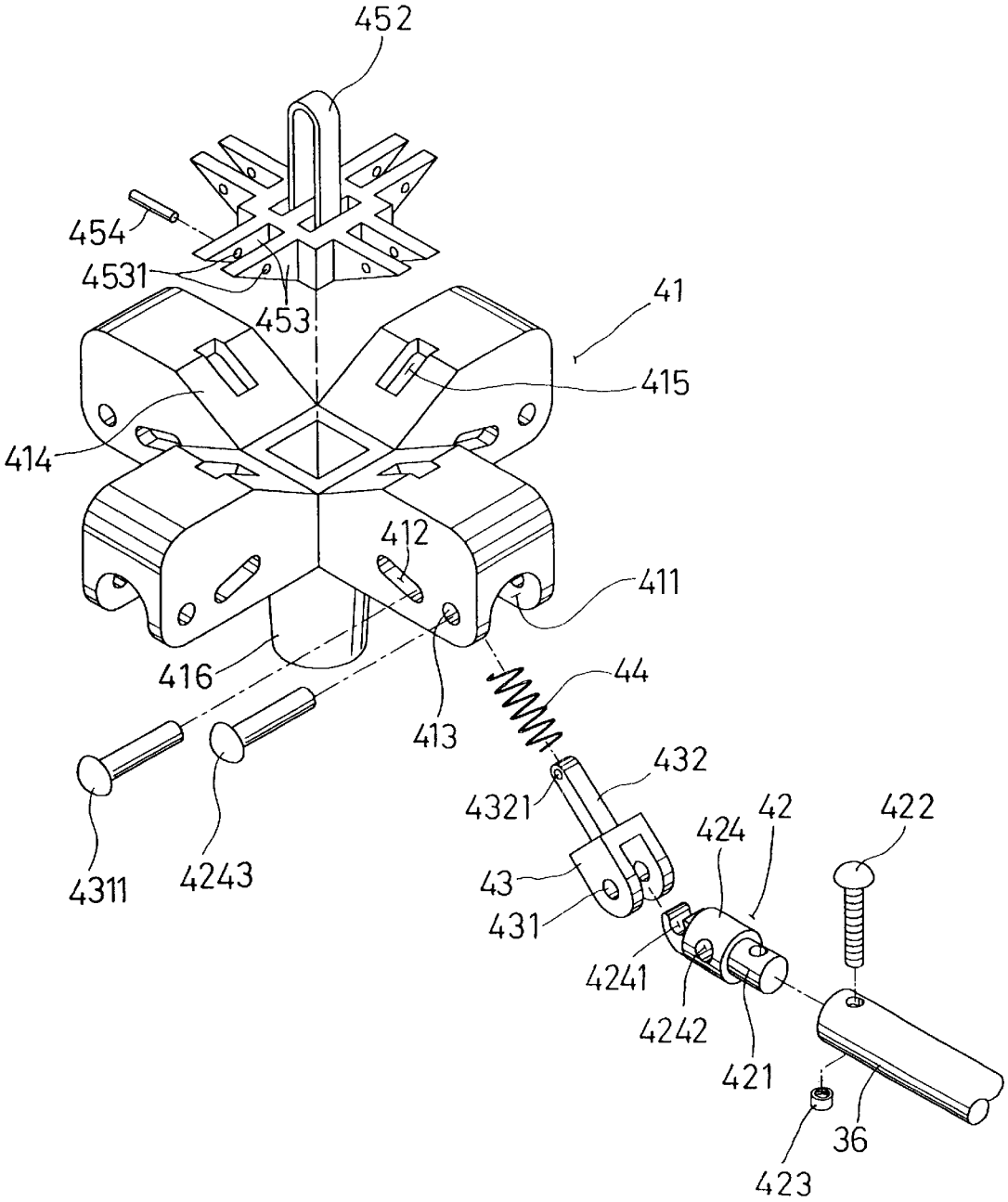
FIG. 7 is an exploded view of a positioning base of the bottom frame structure for a playpen in accordance with another embodiment of the present invention.
Figure 8:
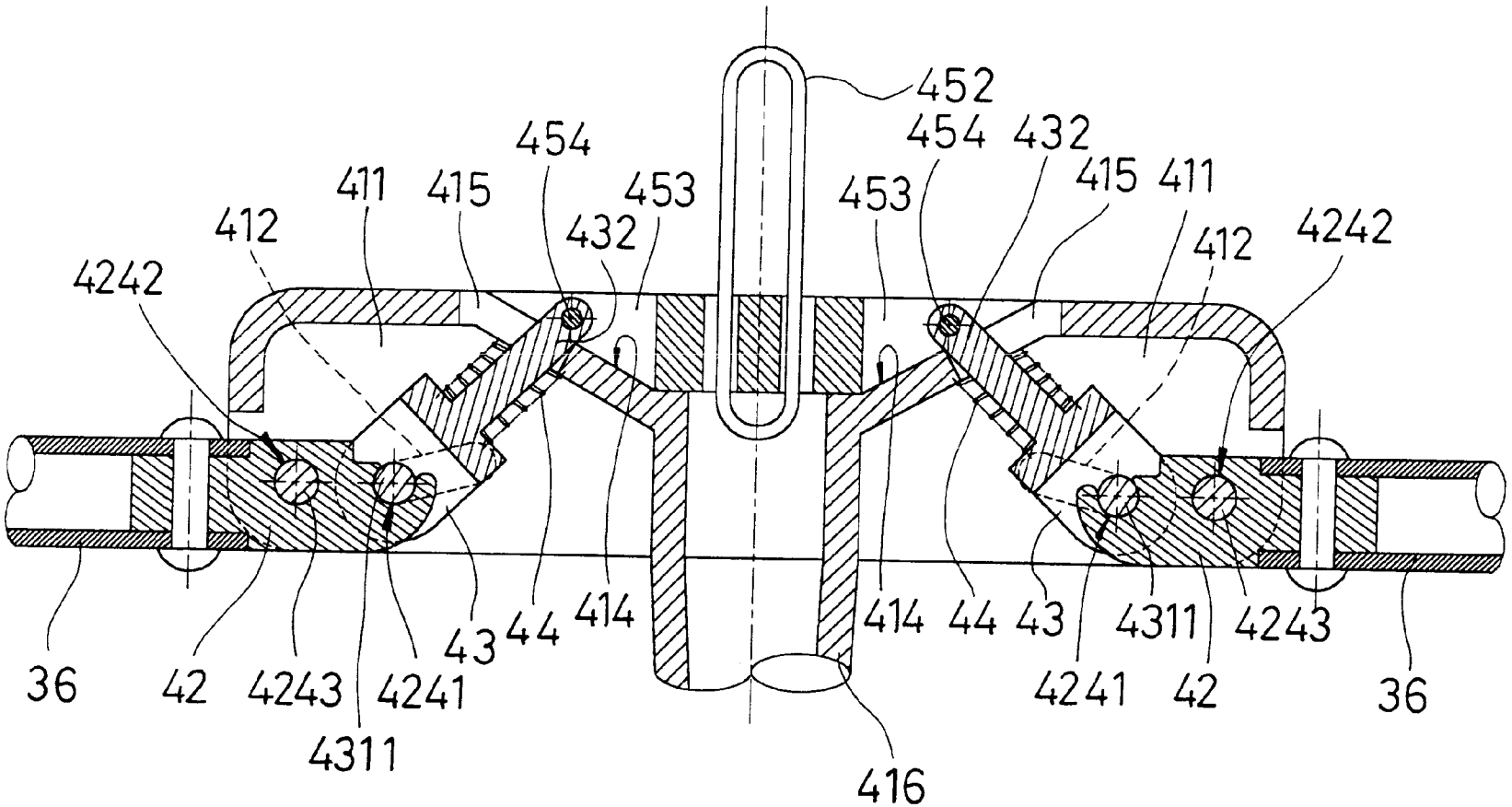
FIG. 8 is a front plan cross-sectional view of the positioning base as shown in FIG. 7.
Figure 9:
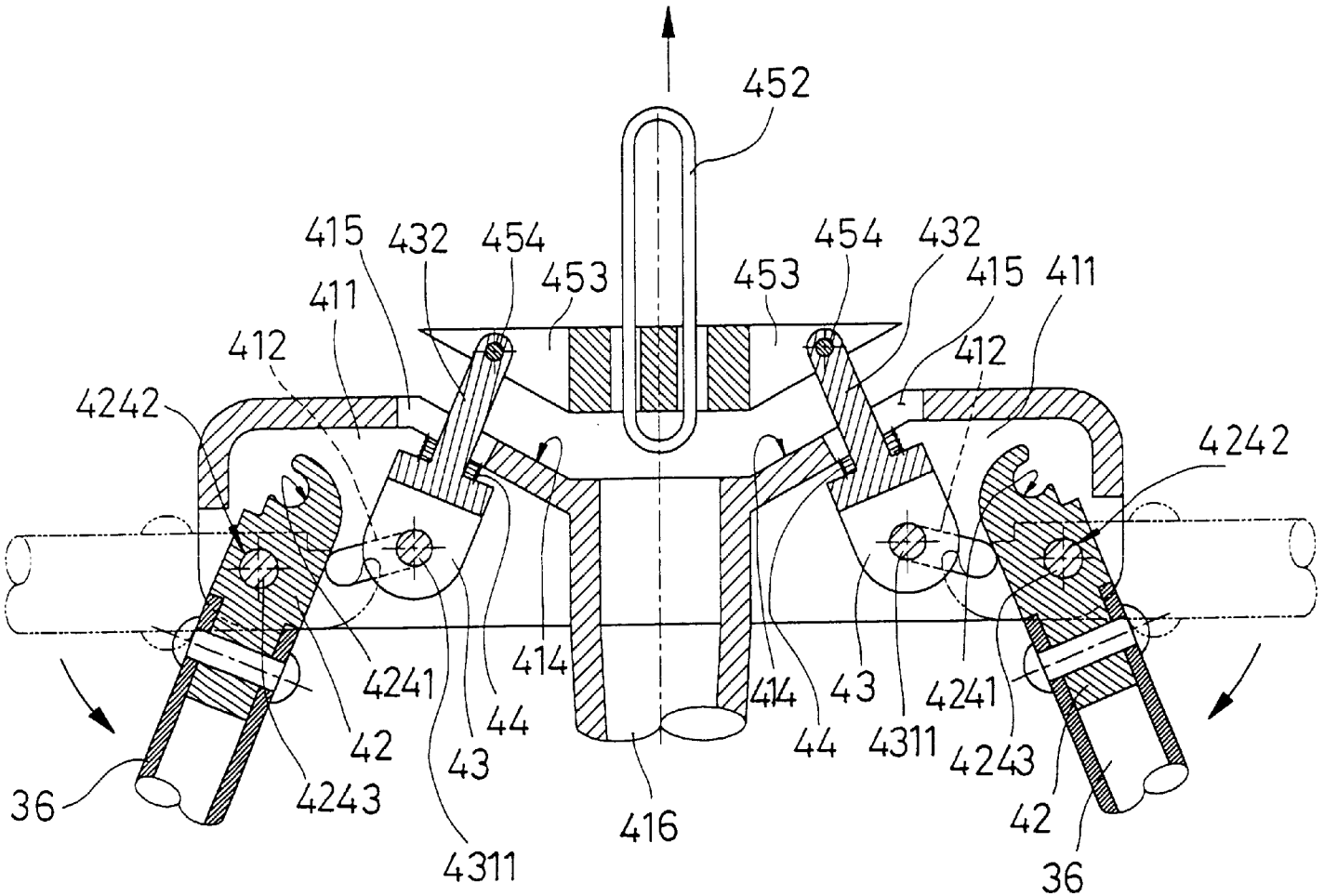
FIG. 9 is an operational view of the positioning base as shown in FIG. 8.

Referring now to FIGS. 7–9, in accordance with another embodiment of the present invention, the snap abutting recess 4241 of each of the fitting rod members 42 has an arcuate shape defining an opening directed upward, and the slide slot 412 of each of the chambers 411 of the body 41 is an elongated oblique slot.

Accordingly, the snap abutting recess 4241 of the fitting rod member 42 is locked by the lock pin 4311 of the urging drive block 43, thereby preventing the skeleton of the playpen from being folded arbitrarily so as to protect the baby in the playpen. In addition, the support points and the connection points of the skeleton of the playpen have a rigid strength, thereby enhancing the loading and supporting strength of the playpen. Further, the bottom frame 3 can be easily folded by pulling the lift strap 452 of the positioning base 4, thereby facilitating the folding of the playpen.

It should be clear to those skilled in the art that further embodiments may be made without departing from the scope of the present invention.

What is claimed is:

1. A bottom frame structure for a playpen comprising: four upright rods (2), a bottom frame (3), a positioning base (4), and a top frame (5), wherein, said four upright rods (2) are respectively located at four corners of said playpen for supporting and linking between said bottom frame (3) and said top frame (5), two of said upright rods (2) having a lower end secured with an inverted L-shaped support base (21), and the other two of said upright rods (2) having a lower end secured with an inverted L-shaped wheel base (22) having a roller (221);

said bottom frame (3) is mounted on the lower end of said four upright rods (2) and includes four first rods (31), two Y-shaped first connecting bases (32), four universal joints (33), four second rods (34), two T-shaped second connecting bases (35), and four third rods (36), said four first rods (31) each having a first end respectively pivoted to the horizontal section of said two support bases (21) and said two wheel bases (22), each of said two Y-shaped first connecting bases (32) having three radially arranged pivot grooves (321) and having a bottom secured with a resting post (322) for supporting said first connecting base (32), two of said three pivot grooves (321) of each of said two Y-shaped first connecting bases (32) pivotally receiving a second end of each of said four first rods (31), each of said four universal joints (33) including a sleeve (331) secured on a mediate portion of each of said four first rods (31), and a U-shaped pivot section (332) which is rotatable toward any direction, each of said four second rods (34) having a first end pivoted to said pivot section (332) of each of said four universal joints (33) so that said four first rods (31) and said four second rods (34) form a rectangular frame, each of said two T-shaped second connecting bases (35) having three pivot slots (351) and having a bottom secured with a resting rod (352) for supporting said second connecting base (35), two of said pivot slots (351) of each of said two T-shaped second connecting bases (35) being in line with each other and each pivotally receiving a second end of each of said four second rods (34), said four third rods (36) being arranged between said first rods (31) and said second rods (34) in a cross intersecting manner, two of said four third rods (36) having a first end pivoted to said pivot groove (321) of each of said two first connecting bases (32) and a second end connected to said positioning base (4), and the other two of said four third rods (36) having a first end pivoted to said pivot slot (351) of each of said two second connecting bases (35) and a second end connected to said positioning base (4);

said positioning base (4) is used to link said four third rods (36) and includes a cruciform body (41), four fitting rod members (42), four U-shaped urging drive blocks (43), four elastic members (44), and a release block (45), said body (41) including four chambers (411) each having an opening directed downward for receiving the second end of each of said four third rods (36), each of said four chambers (411) having two side walls each defining a substantially L-shaped slide slot (412) having an oblique upper end and a horizontal lower end (4121) and a circular hole (413) located beside said horizontal lower end (4121), said body (41) having a top formed with four inclined surfaces (414) each defining a rectangular slot (415) connecting to each of said four chambers (411), and having a bottom secured with an abutting column (416), each of said four fitting rod members (42) having a first end provided with an insertion section (421) secured and locked in the second end of each of said third rods (36) by a threaded rod (422) engaged with a nut (423), and a second end provided with a snap abutting section (424) defining a transverse through hole (4242) and provided with an L-shaped snap abutting recess (4241), a rivet pin (4243) in turn extending through said circular hole (413) of each of said four chambers (411) of said body (41) and through said through hole (4242) of said snap abutting section (424) of each of said four fitting rod members (42), so that each of said four fitting rod members (42) is pivoted to each of said four chambers (411) of said body (41), each of said four urging drive blocks (43) having two side walls each defining a circular hole (431) and having a top portion provided with a rectangular bar (432) having an upper section protruding outward from said rectangular slot (415) of said body (41) and defining a through hole (4321), a lock pin (4311) in turn extending through said slide slot (412) of said body (41) and through said circular hole (431) of each of said four urging drive blocks (43), so that said lock pin (4311) is detachably rested on said snap abutting recess (4241) of each of said four fitting rod members (42), each of said four elastic members (44) is mounted around said rectangular bar (432) of each of said four urging drive blocks (43), and having a lower end pressing the top portion of each of said four urging drive blocks (43) and an upper end pressing an upper wall of each of said four chambers (411) of said body (41), and said release block (45) movably mounted on said body (41) and defining two spaced slot holes (451) for allowing passage of a loop-shaped lift strap (452), said release block (45) having four sides each provided with two spaced abutting plates (453) rested on each of said four inclined surfaces (414) of said body (41), said rectangular bar (432) of each of said four urging drive blocks (43) being received between said two abutting plates (453), each of said abutting plates (453) defining a circular hole (4531) aligning with said through hole (4321) of said rectangular bar (432) of each of said four urging drive blocks (43), a pivot rod (454) in turn extending through said circular hole (4531) of each of said abutting plates (453) and through said through hole (4321) of said rectangular bar (432), thereby pivoting said rectangular bar (432) to said abutting plates (453) of said release block (45).

2. The bottom frame structure in accordance with claim 1, wherein said snap abutting recess (4241) of said fitting rod member (42) has an arcuate shape defining an opening directed upward, and said slide slot (412) of said chamber (411) of said body (41) is an elongated oblique slot.

* * * * *